United States Patent [19]

Comber

[11] 4,127,136

[45] Nov. 28, 1978

[54] TREATMENT OF TOBACCO

[75] Inventor: Richard Comber, Southampton, England

[73] Assignee: British-American Tobacco Company Limited, London, England

[21] Appl. No.: 745,693

[22] Filed: Nov. 29, 1976

[30] Foreign Application Priority Data

Dec. 2, 1975 [GB] United Kingdom ..... 49513/75
Jun. 28, 1976 [GB] United Kingdom ..... 26876/76

[51] Int. Cl.[2] ..... A?4B 3/18
[52] U.S. Cl. ..... 131/140 R; 131/140 B
[58] Field of Search ..... 131/140 R, 140 B, 142 A; 71/65, 74, 69, 92, 71

[56] References Cited

U.S. PATENT DOCUMENTS

| | | | |
|---|---|---|---|
| 2,269,396 | 1/1942 | Jayne, Jr. | 71/65 |
| 3,202,500 | 8/1965 | Homer | 71/92 |
| 3,307,931 | 3/1967 | Unger et al. | 71/65 |
| 3,332,959 | 7/1967 | Braunholtz | 71/74 |

FOREIGN PATENT DOCUMENTS

| | | | |
|---|---|---|---|
| 47-8,998 | 3/1972 | Japan | 131/140 B |

*Primary Examiner*—Robert W. Michell
*Assistant Examiner*—V. Millin
*Attorney, Agent, or Firm*—Kane, Dalsimer, Kane, Sullivan & Kurucz

[57] ABSTRACT

A method for the treatment of tobacco, including curing and drying thereof, comprises applying a leaf-wilt accelerating chemical agent to parts of growing mature tobacco plants, allowing the leaves to wilt over a period of 2 to 50 days to effect a reduction of the water content of the leaves of at least one quarter by weight without killing the whole plant, harvesting the leaves and processing the harvested leaves for use as tobacco-smoking, chewing or snuff products. The agent may be applied by spraying the leaves or by way of the roots or stalks of the plants.

8 Claims, No Drawings

TREATMENT OF TOBACCO

This invention concerns improvements relating to treatment, including curing and drying, of tobacco.

Tobacco is cured by one of several processes, depending on the type of tobacco. For example, Virginia tobacco leaves are removed from the plant when ripe, either by hand or by machine, and are placed in curing barns in which they are treated by warm-air convection or by forced warm-air current. In either case, the process takes about 5–6 days. Burley type tobaccos or tobaccos used for the production of cigars are generally air-cured. Usually the stalks are cut and the whole plants are hung up in the barns, where the leaves are allowed to dry slowly in air over a period of several weeks. In both types of curing, the green colour (due to chlorophyll) is allowed to disappear before the leaves are dried. These known methods are time-consuming and laborious and the present invention seeks to accelerate the process of curing and drying tobacco leaves.

According to the invention, a method for the treatment of tobacco, including curing and drying thereof, comprises applying a leaf-wilt accelerating chemical agent to parts of growing mature tobacco plants, allowing the leaves to wilt over a period of 2 to 50 days to effect a reduction of the water content of the leaves of at least one quarter, preferably 40 to 90%, which corresponds to 36 - 80% reduction in total weight of leaves, by weight without killing the whole plant, harvesting the leaves and processing the harvested leaves for use as tobacco-smoking, chewing or snuff products. This reduction of water content may involve a reduction of the total weight of the leaves of from 20 to 90%.

The wilt-accelerating agent may be applied directly to the leaves, for example by spraying. Alternatively, the agent may be applied to the roots of the plants, again for example by spraying, or to the stalks, for example by needleless injection. In the two latter cases, the agent employed is one which migrates to the leaves to produce leaf-wilt acceleration. The wilting period will depend upon the agent employed and its mode of application. It will preferably be between 5 and 15 days in practice. Depending upon the extent of the drying effected by the pre-harvesting treatment and upon the final moisture content or the weight required, the processing may include further drying, particularly vacuum drying or air drying by a flow of warm air such as is employed in crop-driers. Such further drying may be continued over a period of from 2 hours to 7 days so as to effect the required further reduction of weight and, possibly, to complete curing. Further reduction of weight of the leaves, if required, may be within the range of 1 to 70% of their original weight, but the pre-harvesting treatment may more practicably be designed to leave the required further reduction within narrower limits, say 10 to 60%. It is essential that the leaves should be dried to the extent that micro-organisms will not grow, otherwise the leaves will be spoiled. Whichever the method of drying, the mid-ribs are the last part of the leaves to dry. The air drying may be continued until the mid-ribs are also dry or their drying may be completed after separation from the lamina. Further processing may include such steps as removal of stem material, fermentation, pressing, humidification, removal of wet material, blending, cutting or shredding, and manufacture of the particular tobacco product.

Thus, with the treatment according to the invention, a curing and drying operation is applied in the field prior to harvesting to tobacco plants grown to maturity. By allowing the leaves to wilt, they are at least partly cured and dried.

Harvesting, which may be carried out by simple means such as by forage-harvesting machines, is simplified, as the cured or partially cured leaves are not sensitive to bruising and have a lower bulk weight.

The pre-harvesting curing of the tobacco has the effect of producing yellow and some brown leaves of predeterminable moisture content without heat-treatment. The smoke of a tobacco produce made from tobacco thus treated is not adversely affected. Generally it is less acid than the smoke of Virginia flue-cured tobacco and resembles that of the smoke of Burley or air-cured tobacco.

Suitable leaf-wilt accelerating agents include both organic and inorganic substances. For spraying the leaves, use may be made of agents which cause so-called lethal synthesis in which the leaf's biosynthetic system forms a herbicidal substance in the leaf, the applied agent serving as starting material. Alternatively, use may be made of an agent which prevents the breakdown of materials naturally present in the leaf, such as hydrogen peroxide, so that such materials accumulate and are responsible for the wilt-accelerating action. Agents of these kinds include sodium chlorate modified by the inclusion of an anti-combustion agent, and bipyridylium compounds such as 1,1'-ethylene-2,2'-bipyridylium salts and 1,1'-dimethyl-4,4'-bipyridylium salts.

For application to the root system, use may again be made of chlorates, particularly sodium chlorate. Although sodium chlorate may be regarded as a drastic herbicide, it is easily diluted and is rapidly leached when applied to plants growing in a light sandy soil. Virginia Tobacco is usually grown in such soil, so that there is no detrimental effect on the tobacco product when sodium chlorate is used for Virginia tobacco. Other agents suitable for root application include acids and bases, for example phosphoric, nitric and perchloric acids. When these are diluted, for example by rain water, they have the additional beneficial effect of acting as a fertilizer.

For treatment by way of the stalks, a bipyridylium compound is preferably employed.

Substances used as leaf-wilt accelerating agents for the present purpose must naturally not result, in the tobacco product, in any toxic effect harmful to human beings. They must also have no detrimental effect upon the tobacco product, for example by leaving a residue which might be transferred to smoke. They should materially affect only the leaves by acceleration of their wilting. Herbicides, in general, are so applied as to kill the whole plant and may be selective with respect to the type of plant. Generally, agents used as leaf-wilt accelerators for the present purpose will be applied at concentrations lower than the concentrations commonly employed to kill whole other plants.

Many weed-killing subtances, such as phenoxy compounds, picloram and benzoic compounds, have auxin-like properties for example. They do not wilt the leaves, but have a distorting effect and are therefore unsuitable for the present purpose. Also unsuitable are substances which inhibit growth, for example by blocking cell divisions, such as amides, carbamates, dinitroanilines, bensulide, nitriles and dimethyl tetrachloroterephthalate. Similarly unsuitable are growth-retarding substances such as 2, 3, 6 - trichlorophenyl acetic acid and maleic hydrazide. Substances containing arsenic should also not be employed. Although chloroethyl phosphonic acid would yellow tobacco leaves, it has no desiccating effect and would not wilt the leaves.

The following examples illustrate ways of carrying out the pre-harvesting treatment and the results obtained:

EXAMPLE 1

Two liters of a 1% aqueous sodium chlorate solution were applied to the roots of mature tobacco plants of Burley type by spraying the soil immediately around the plants. Leaves picked 11 days after this treatment weighed 164 g and, after 24 hours final vacuum drying, 54.8 g.

We estimated the weight of the fresh leaves before treatment as follows: Fresh, untreated, leaves were picked and found to weight 421 g. These leaves, after vacuum drying, weighed 50.2 g. The ratio of fresh to dry weight of the untreated leaves, namely 421/50.2 = 8.39, was used for calculating the original fresh weight, before treatment, of the treated leaves. The fresh weight of the treated leaves was, therefore, 54.8 × 8.39 = 460 g.

The reduction in water content achieved by the pre-harvest treatment was calculated by taking the weight of the fresh treated leaves minus the weight of the partly dried treated leaves divided by the weight of the fresh treated leaves minus the weight of the fully dried leaves, namely $$\frac{460 - 164}{460 - 54.8} \times 100 = 73\%.$$

EXAMPLE 2

3 ml of a 10% aqueous solution of sodium chlorate were applied by spraying to a leaf of a ripe Burley tobacco plant. This leaf was picked 12 days after treatment and weighed 26 g. After final vacuum-drying, its weight was 7.7 g.

For calculating the weight of the fresh leaf before treatment as in Example 1, two fresh untreated leaves, adjacent on the plant to the treated leaf, were picked and found to weigh 119 g. After vacuum drying, the weight was 15.1 g. The ratio of fresh to dry weight of the untreated leaves, namely 119/15.1 = 7.88. The calculated original fresh weight, before treatment, of the treated leaf was, therefore, 7.7 × 7.88 = 60.7 g.

The reduction in water content achieved by the pre-harvest treatment was calculated $$\frac{60.7 - 26}{60.7 - 7.7} \times 100 = 65\%$$

EXAMPLE 3

Two liters of a 4% aqueous phosphoric acid solution were applied to the roots of mature tobacco plants of Burley type. Leaves picked 11 days after this treatment weighed 301 g and, after 24 hours final vacuum drying, 58.5 g. The ratio of fresh to dry weight of untreated leaves was 8.39 and the fresh weight of the treated leaves was calculated as 58.5 × 8.39 = 491 g.

The reduction in water content achieved by the pre-harvest treatment was $$\frac{491 - 301}{491 - 58.5} \times 100 = 44\%$$

EXAMPLE 4

50 ml of an aqueous solution containing 0.0009% w/v of 1,1'-ethylene-2,2'bipyridylium dibromide were sprayed on to a mature Burley tobacco plant. Leaves picked 9 days after this treatment weighed 134 g and, after final vacuum drying, 44.8 g.

Fresh untreated leaves picked from a similar plant were weighed 659 g. and, after vacuum drying, 73.7 grams, so that the ratio of fresh to dry weight of the untreated leaves was 659/73.7 = 8.94 and the calculated original fresh weight of the treated leaves was 44.8 × 8.94 = 401 g. The calculated reduction in water content achieved by the pre-harvest treatment was $$\frac{401 - 134}{401 - 44.8} \times 100 = 75\%$$

EXAMPLE 5

25 ml of an aqueous solution containing 0.0009% w/v of 1,1'-ethylene-2,2'bipyridylium dibromide were sprayed on to a mature Virginia tobacco plant. Leaves picked 9 days after this treatment weighed 58.1 g and, after final vacuum drying, 32.0 g.

Fresh untreated leaves picked from a similar plant were found to weight 423 g and, after vacuum drying, 52.1 g, the ratio of fresh to dry weight of the untreated leaves being 423/52.1 = 8.12 and the calculated fresh weight of the treated leaves 32.0 × 8.12 = 260 g.

The calculated reduction in water content achieved by the pre-harvest treatment was $$\frac{260 - 58.1}{260 - 32.0} \times 100 = 88\%$$

EXAMPLE 6

0.3 ml of a solution of 140 g of 1,1'-ethylene-2,2'-bipyridylium dibromide per liter, in the form available under the name "Reglone" (Registered Trade Mark), was injected into the stalk of a mature Burley plant using a known form of needleless injector. Leaves picked nine days after this treatment weighed 141.0 g and, after twenty-four hours final vacuum drying, 46.4 g.

Fresh untreated leaves picked from a similar plant weighed 658.8 g and, after vacuum drying, 73.7 g. From the ratio of these weights, 658.8/73.7 = 8.94, the original fresh weight of the treated leaves was estimated, as 46.4 × 8.94 = 414.8 g. The reduction in water content achieved by the pre-harvesting treatment was, $$\frac{414.8 - 141.0}{414.8 - 46.4} \times 100 = 74\%$$

EXAMPLE 7

0.3 ml of a solution of 140 g of 1,1'-ethylene-2,2'-bipyridylium dibromide per liter, in the form available under the name "Reglone", was injected into the stalk of a mature Virginia plant using a needleless injector. Leaves picked nine days after this treatment weighed 88.1 g and, after twenty-four hours final vacuum drying, 34.4 g.

Fresh untreated leaves also picked weighed 422.5 g and, after vacuum drying, 52.1 g. The ratio 422.5/52.1 = 8.11 was again used for calculating the fresh weight of the treated leaves, namely 34.4 × 8.11 = 279.0 g.

The reduction in water content achieved by the pre-harvest treatment was therefore $$\frac{279.0 - 88.1}{279.0 - 34.4} \times 100 = 78\%$$

Processing of the tobacco leaves after the treatment described in any of the above Examples will, as required, include some at least of the steps comprising further drying, removal of stem material, fermentation, pressing, humidification, removal of wet material, blending, cutting or shredding and working up to the required final tobacco product.

I claim:

1. A method for the treatment of tobacco, including curing and drying thereof, comprising applying a leaf-wilt accelerating desiccating chemical agent to parts of growing mature tobacco plants, allowing the leaves to wilt and cure over a period of 2 to 50 days to effect a reduction of the water content of the leaves of at least one quarter by weight without killing the whole plant, harvesting the leaves and processing the harvested leaves for use as tobacco products.

2. A method according to claim 1, wherein the wilt accelerating agent is applied by spraying the leaves.

3. A method according to claim 1, wherein the wilt accelerating agent is applied by way of the roots of the plants.

4. A method according to claim 1, wherein the wilt accelerating agent is applied by way of the stalks of the plants.

5. A method according to claim 1, wherein the wilt accelerating agent is introduced into the stalks of the plants by needleless injection.

6. A method according to claim 1, wherein the wilt accelerating agent is 1,1′-ethylene-2,2′-bipryidylium dibromide.

7. A method according to claim 1, wherein the wilt accelerating agent is a sodium chlorate solution.

8. A method according to claim 1, wherein the wilt accelerating agent is a phosphoric acid solution.

* * * * *